US009801439B2

(12) United States Patent
Nie

(10) Patent No.: US 9,801,439 B2
(45) Date of Patent: Oct. 31, 2017

(54) DIY SPLICING ASSEMBLY AND HANDBAG MADE BY THE SAME

(71) Applicant: Yindi Nie, Shenzhen (CN)

(72) Inventor: Yindi Nie, Shenzhen (CN)

(73) Assignee: Wuxi Sino Intellectual Property Agency Ltd., Jiangsu (CN)

( * ) Notice: Subject to any disclaimer, the term of this patent is extended or adjusted under 35 U.S.C. 154(b) by 330 days.

(21) Appl. No.: 14/574,395

(22) Filed: Dec. 18, 2014

(65) Prior Publication Data

US 2016/0174672 A1 Jun. 23, 2016

(51) Int. Cl.

| | |
|---|---|
| ***A45C 13/40*** | (2006.01) |
| ***A45C 3/06*** | (2006.01) |
| ***A45C 3/00*** | (2006.01) |

(52) U.S. Cl.

CPC ..... *A45C 3/06* (2013.01); *A45C 3/001* (2013.01)

(58) Field of Classification Search

CPC ..... A45C 3/06; A45C 3/00; A45C 13/083; A45C 1/02; A45C 7/0077

USPC ..... 150/127, 103, 106, 107, 128, 129; 428/33, 52; 24/108, 109, 114.9, 3.12, 24/513

See application file for complete search history.

(56) References Cited

U.S. PATENT DOCUMENTS 892,807 A * 7/1908 Caroli et al. ..... A47C 23/155 152/171
1,817,519 A * 8/1931 Mandalian ..... A45C 13/083 427/415
2,404,846 A * 7/1946 Kalisher ..... A45C 13/083 29/433
2,418,327 A * 4/1947 Whyte ..... A45C 13/083 150/127
3,661,689 A * 5/1972 Spanier ..... E04H 15/32 24/DIG. 50
3,746,602 A * 7/1973 Caroli et al. ..... A41D 31/0005 2/243.1
4,198,733 A * 4/1980 Ferguson ..... A44B 1/12 24/113 R
4,564,539 A * 1/1986 Tsuji ..... A41D 31/0005 428/33
5,279,876 A * 1/1994 Thum ..... A47C 7/742 428/52
6,012,203 A * 1/2000 Baron Pearson ..... A41D 27/08 24/108

(Continued)

*Primary Examiner* — Fenn C Mathew
*Assistant Examiner* — Cynthia Collado
(74) *Attorney, Agent, or Firm* — EcoTech Law Group P.C.

(57) ABSTRACT

The present invention discloses a DIY splicing assembly and a handbag made by the same. The DIY splicing assembly comprises a plurality of basic pieces, a plurality of two-leg fasteners, a plurality of four-leg fasteners, a plurality of decorative pieces, and a plurality of decorative piece connecting components. The handbag made by the DIY splicing assembly comprises a main body and a hand-strap. The main body defines a bottom surface and four side surfaces connected to the bottom surface. The hand-strap is then connected onto the main body through the four-leg fasteners. Through the DIY splicing assembly provided by the present invention, the handbag with elegant appearance is made by flexible splicing. Furthermore, it is simple for a user to know how to make the handbag and thus to enjoy the process of DIY.

10 Claims, 9 Drawing Sheets

(56) References Cited

U.S. PATENT DOCUMENTS

| | | | | |
|---|---|---|---|---|
| 2008/0155788 | A1* | 7/2008 | Wilcox | A43B 3/0078 24/3.1 |
| 2009/0094794 | A1* | 4/2009 | Murray | A43B 3/0078 24/3.12 |
| 2009/0205759 | A1* | 8/2009 | Vaccarella | A45C 3/04 150/108 |

* cited by examiner

DIY SPLICING ASSEMBLY AND HANDBAG MADE BY THE SAME

BACKGROUND OF THE INVENTION

1. Field of the Invention

The present invention relates to the field of DIY, in particular to a DIY splicing assembly and a handbag made by the same.

2. Description of Related Art

DIY (Do It Yourself, DIY for short) means making handicrafts yourself. The most common handicrafts are hand knitting, hand embroidery (cross-stitch), manual paper folding, hand fabric embellishing, hand beading and the like. DIY, due to the uniqueness and personality of the finished handicrafts and the great comforts brought to users during the production process, is more and more popular in the fashionable youth.

At present, there have been numerous hand-knitted bags on the market, including bamboo and rattan bags, plastic bags, cloth bags, beaded bags and the like in terms of material, as well as handbags, shoulder bags, messenger bags and the like in terms of style. Usually, these handmade bags are knitted by professional personnel using special knitting tools for one day to half a month, depending upon style and material. For DIY by a user, there are usually two kinds of bags. One kind is simple in style, for example, a bag to be formed by concatenating a plurality of pieces together by a strand. This results in finished products of poor aesthetic sense and insufficient practicability although providing a DIY process for the user. The other kind is relatively complex in style. A user needs to participate in relevant DIY clubs to be trained by professional persons to finish a handcraft gradually. Alternatively, a user is required at least to learn tutorials and practice for many times to make a satisfactory bag. This is both time and energy consuming. Therefore, it is difficult for persons living in an intense pace to go very far and instead give up halfway.

SUMMARY OF THE INVENTION

This section is for the purpose of summarizing some aspects of the present invention and to briefly introduce some preferred embodiments. Simplifications or omissions in this section as well as in the abstract or the title of this description may be made to avoid obscuring the purpose of this section, the abstract and the title. Such simplifications or omissions are not intended to limit the scope of the present invention.

An objective of the present invention is to provide a DIY splicing assembly and a handbag made by the same. The splicing process is simplified and becomes simple for users; furthermore, the finished products have diversified styles, varied and nice appearance, and high practicability.

To solve the above technical problem, according to an aspect of the present invention, the present invention provides a DIY splicing assembly. The DIY splicing assembly comprises: a plurality of basic pieces each having a rectangular shape and defining four connecting holes in four corners thereof respectively; a plurality of two-leg fasteners each having two legs fitting the connecting holes and a connecting rod connecting the two legs, and configured to connect two basic pieces adjacent to each other; a plurality of four-leg fasteners each having four legs fastened to the connecting holes and a connecting piece connecting the four legs, and configured to connect four basic pieces adjacent to each other; a plurality of decorative pieces each defining a plurality of through holes matching with the connecting holes; and a plurality of decorative piece connecting components each comprising a bottom leg fastener and at least one pressing member, the bottom leg fastener having four legs fastened to the connecting holes and a platform connecting the four legs and defining an inserting hole, the pressing member having an inserting rod on the bottom thereof mating with the inserting hole, and a pressing boss formed at an upper end of the inserting rod, a recess mating with a bottom of the inserting rod being provided in a middle of the pressing boss.

According to an aspect of the present invention, the present invention provides A splicing handbag, comprising: a main body defining a bottom surface and four side surfaces connected to the bottom surface, the main body comprising: a plurality of basic pieces each having a rectangular shape and defining four connecting holes in four corners thereof respectively; a plurality of two-leg fasteners each having two legs fitting the connecting holes and a connecting rod connecting the two legs, and configured to connect two basic pieces adjacent to each other to form an upper edge of the main body; a plurality of three-leg fasteners each having three legs fastened to the connecting holes and a crossing rod connecting the three legs and configured to connect the basic pieces to be spliced vertically in two to form a wrapped corner with a right angle of the main body; a plurality of four-leg fasteners each having four legs fastened to the connecting holes and a connecting piece connecting the four legs, and configured to connect four basic pieces adjacent to each other to form a bottom surface and four side surfaces of the main body; a hand-strap comprising a handgrip portion and fastening portions defining a plurality of through holes mating with the connecting holes on the main body.

Compared with the prior art, the present invention has the following advantages by adopting the technical solutions mentioned above.

First, the DIY splicing assembly provided by the present invention includes basic pieces, two-leg fasteners, three-leg fasteners, four-leg fasteners, decorative pieces and decorative piece connecting components. By splicing the basic pieces together using the two-leg fasteners, the three-leg fasteners and the four-leg fasteners to freely form assemblies of different shapes and then embellishing the decorative pieces on the assemblies using the decorative piece connecting components, planar or stereoscopic products, such as storage boxes, curtains and murals, may be formed. Users may make various DIY products in their own likeness and enjoy the process. Furthermore, the splicing is convenient and easy to be mastered, requiring no professional guidance or tutorial.

Second, each of the basic pieces is of a double-layer hollow structure filled with a spongy material, a fragrant material or a thermochromic material, thereby making the splicing more interesting and further improving the stereoscopic impression of the finished products. The finished handbags feel exquisite.

Third, an inner bag is further provided inside the handbag, thereby increasing the practicability of the handbag.

Other objects, features, and advantages of the present invention will become apparent upon examining the following detailed description of an embodiment thereof, taken in conjunction with the attached drawings.

BRIEF DESCRIPTION OF THE DRAWINGS

These and other features, aspects, and advantages of the present invention will become better understood with regard to the following description, appended claims, and accompanying drawings where:

DETAILED DESCRIPTION OF THE EMBODIMENTS

Figure 1:
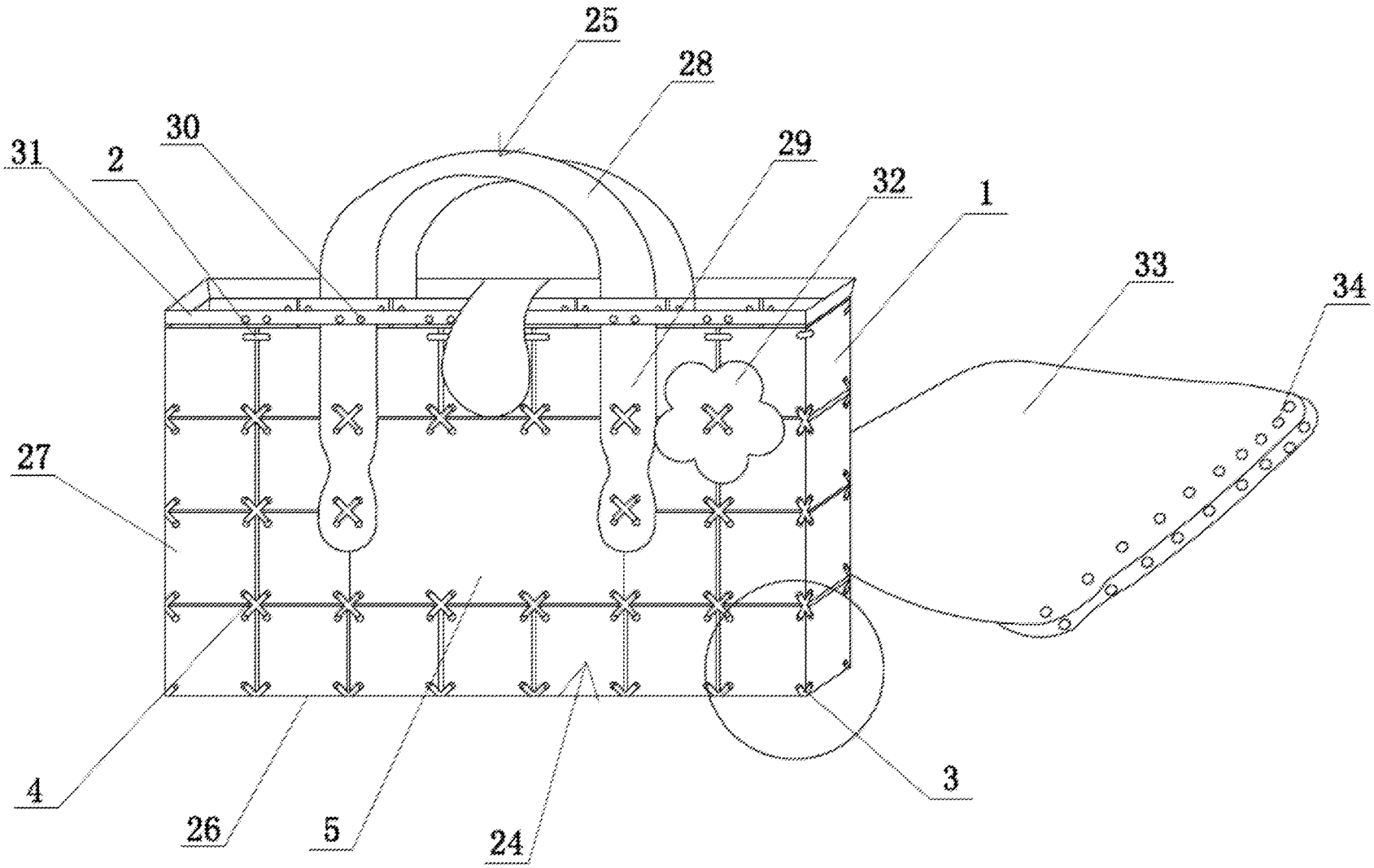
FIG. 1 is a schematic structural view of a handbag according to Embodiment 1 of the present invention.
Figure 2:
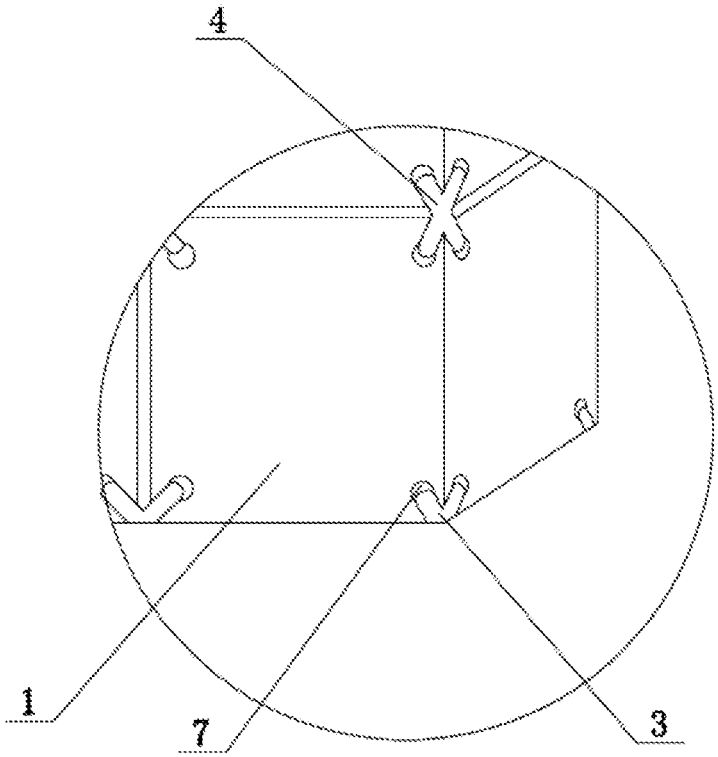
FIG. 2 is a partially enlarged view of FIG. 1.
Figure 3:
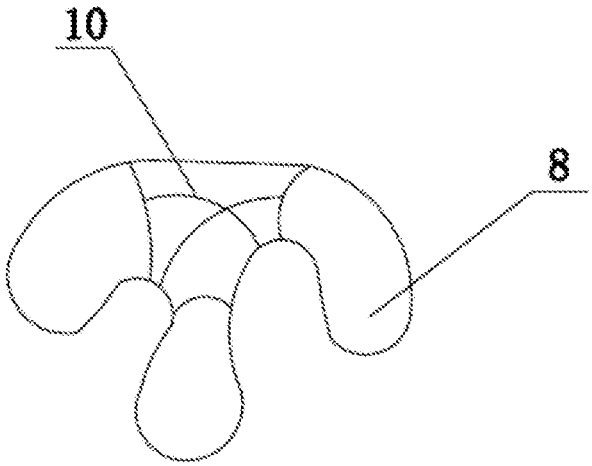
FIG. 3 is a schematic structural view of a three-leg fastener according to Embodiment 1 of the present invention.
Figure 4:
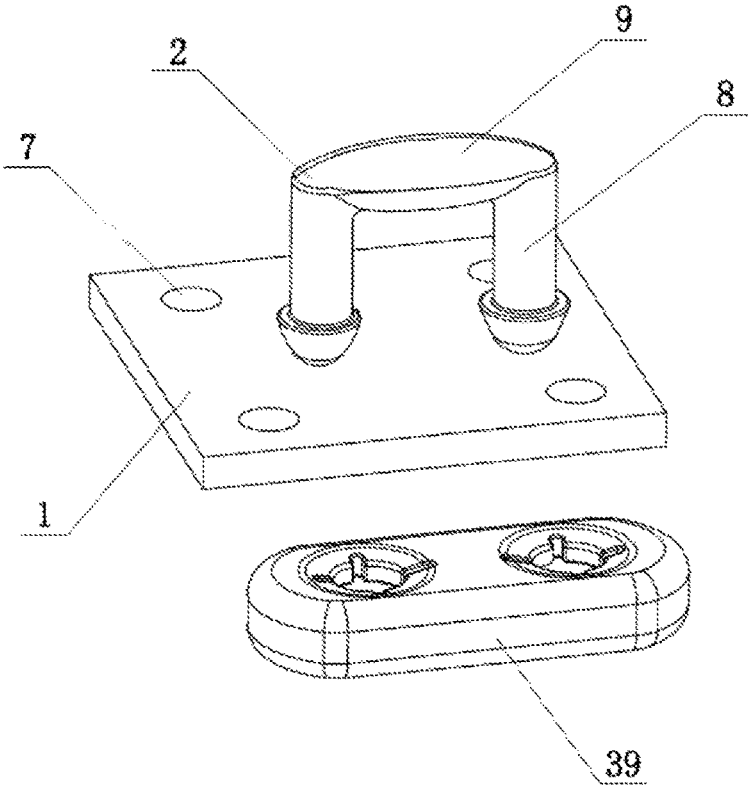
FIG. 4 is a schematic structural view of a use state of a two-leg fastener according to Embodiment 1 of the present invention.
Figure 5:
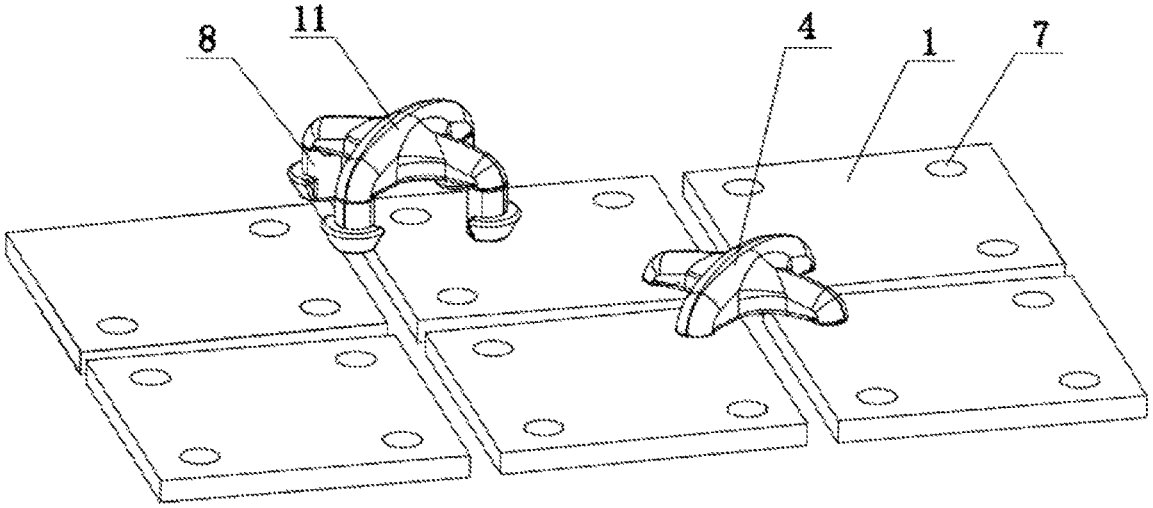
FIG. 5 is a schematic structural view of a use state of a four-leg fastener according to Embodiment 1 of the present invention.
Figure 6:
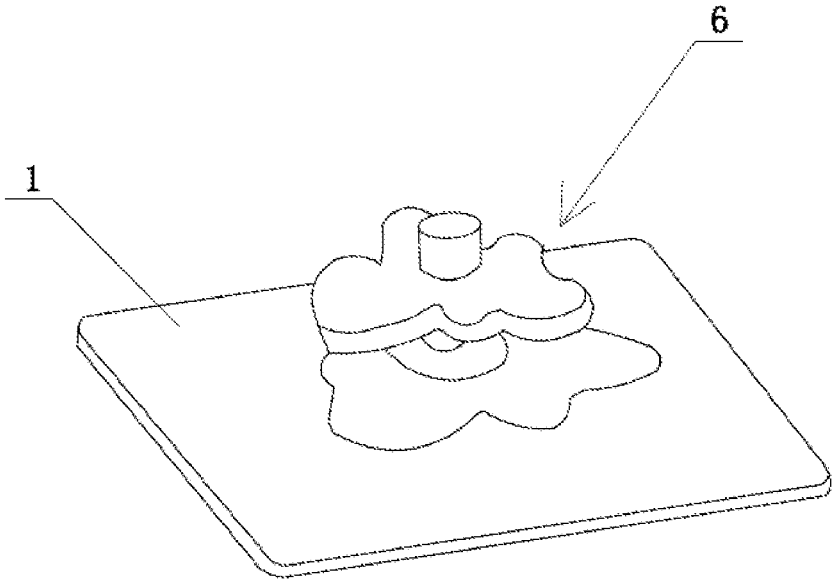
FIG. 6 is a schematic structural view of a use state of a decorative piece connecting component according to Embodiment 1 of the present invention.
Figure 7:
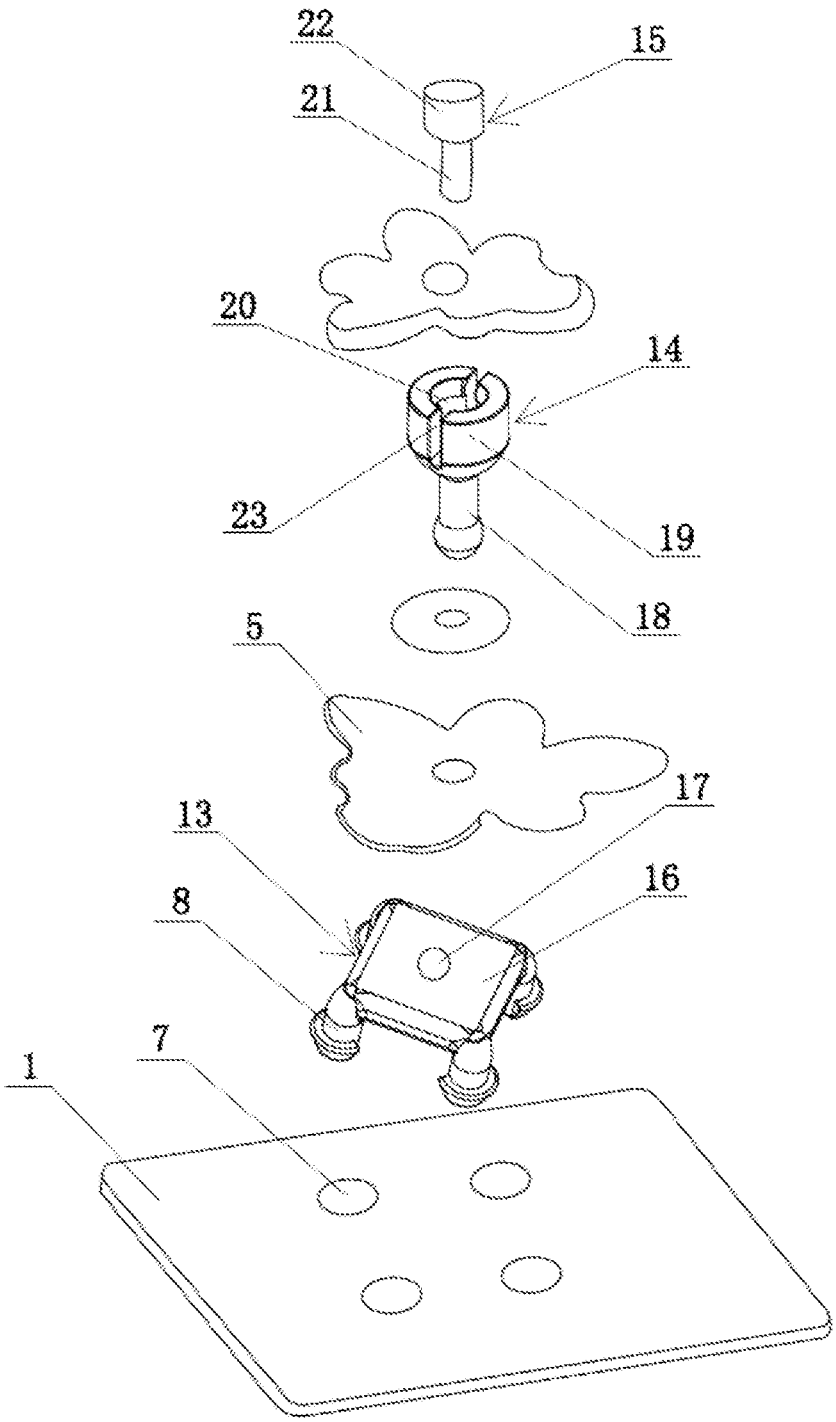
FIG. 7 is an exploded schematic structural view of FIG. 6.
Figure 8:
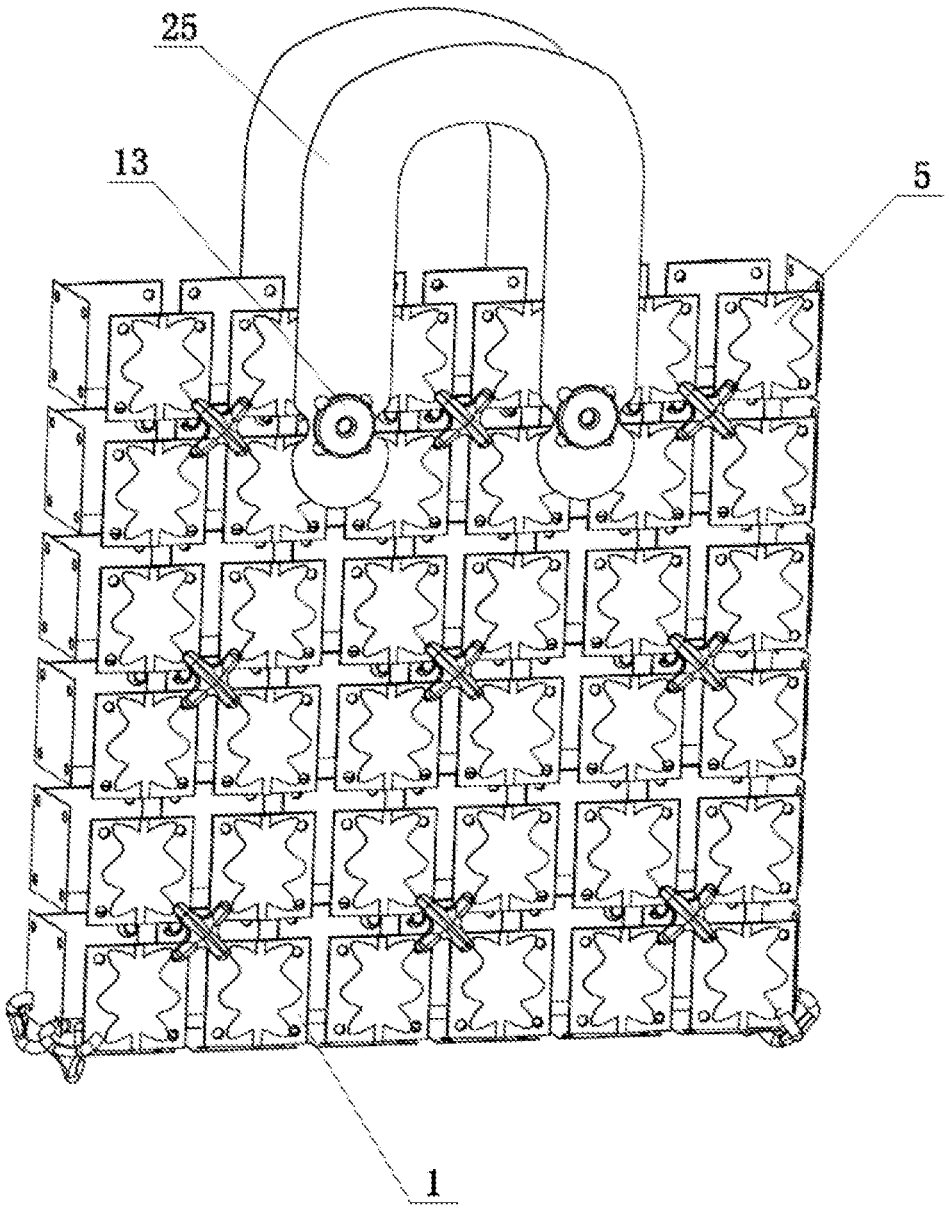
FIG. 8 is a schematic structural view according to Embodiment 2 of the present invention.
Figure 9:
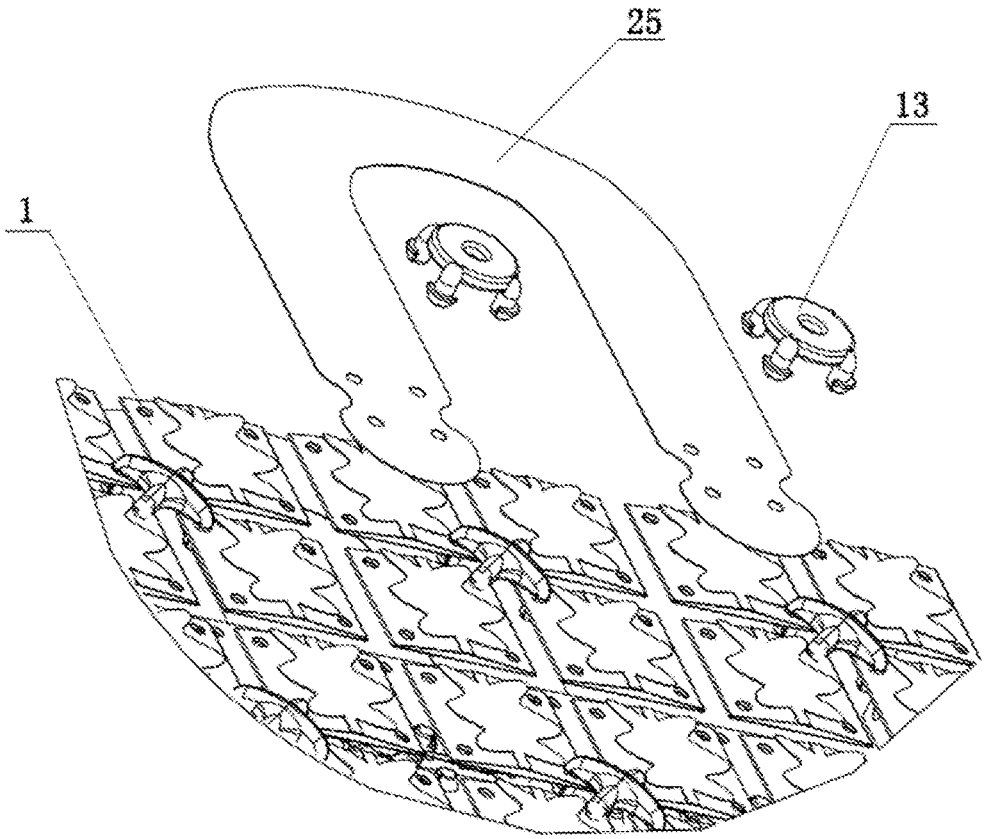
FIG. 9 is a schematic structural view of a handgrip portion according to Embodiment 2 of the present invention.
Figure 10:
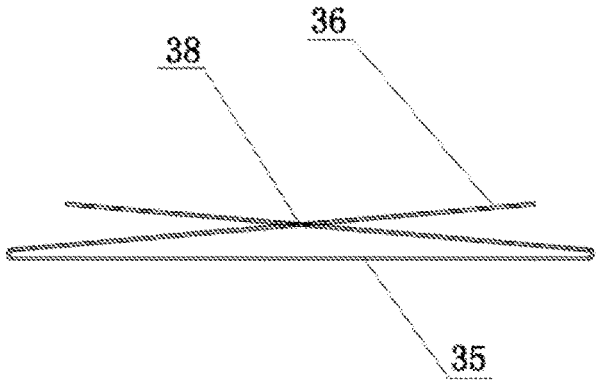
FIG. 10 is a schematic structural view of a basic piece according to Embodiment 2 of the present invention.
Figure 11:
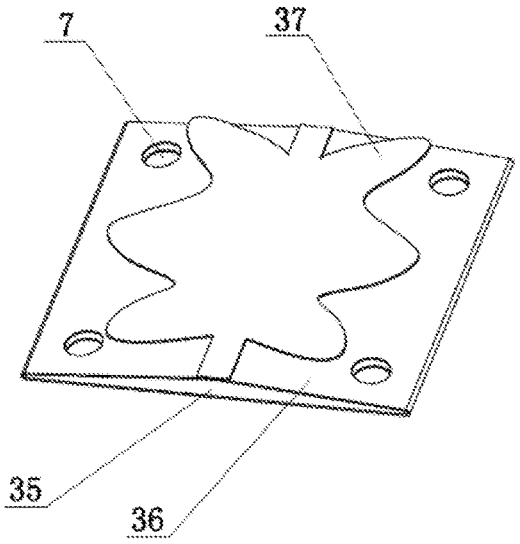
FIG. 11 is a stereoscopic schematic structural view of FIG. 10.

The detailed description of the present invention is presented largely in terms of procedures, steps, logic blocks, processing, or other symbolic representations that directly or indirectly resemble the operations of devices or systems contemplated in the present invention. These descriptions and representations are typically used by those skilled in the art to most effectively convey the substance of their work to others skilled in the art.

Reference herein to "one embodiment" or "an embodiment" means that a particular feature, structure, or characteristic described in connection with the embodiment can be included in at least one embodiment of the invention. The appearances of the phrase "in one embodiment" in various places in the specification are not necessarily all referring to the same embodiment, nor are separate or alternative embodiments mutually exclusive of other embodiments. Further, the order of blocks in process flowcharts or diagrams or the use of sequence numbers representing one or more embodiments of the invention do not inherently indicate any particular order nor imply any limitations in the invention.

The present invention is further described as below with reference to the accompanying drawings and exemplary embodiments.

First Embodiment

Referring to FIGS. 1-7, a DIY splicing assembly is provided, including a plurality of basic pieces 1, a plurality of two-leg fasteners 2, a plurality of three-leg fasteners 3, a plurality of four-leg fasteners 4, a plurality of decorative pieces 5 and decorative piece connecting components 6.

Each of the basic pieces 1 is rectangular and has a connecting hole 7 formed in each of four corners, respectively.

Each of the two-leg fasteners 2 is formed of two legs 8 fastened to the connecting holes 7 and a connecting rod 9 connecting the two legs 8, and is configured to connect the basic pieces 1 contiguous to each other in two.

Each of the three-leg fasteners 3 is formed of three legs 8 fastened to the connecting holes 7 and a crossing rod 10 connecting the three legs 8, and is configured to connect the basic pieces 1 to be spliced vertically in two to form a wrapped corner with a right angle.

Each of the four-leg fasteners 4 is formed of four legs 8 fastened to the connecting holes 7 and a connecting piece 11 connecting the four legs 8, and is configured to connect the basic pieces 1 contiguous in four directions.

Each of the decorative pieces 5 define a plurality of through holes matching with the connecting holes 7.

Each of the decorative piece connecting components 6 includes a bottom leg fastener 13, a pressing member 14, and a cap 15. The bottom leg fastener 13 includes four legs 8 fastened to the connecting holes 7 and a platform 16 connecting the four legs 8. An inserting hole 17 is formed on the platform 16. An inserting rod 18 mating with the inserting hole 17 is provided on a bottom of the pressing member 14. A pressing boss 19 is provided at an upper end of the inserting rod 18. A recess 20 mating with the bottom of the inserting rod 18 is provided in the middle of the pressing boss 19. The cap 15 includes an inserting end 21 having a bottom in plug-in fit to the recess 20 and a crown 22 having a top covering a top face of the pressing member 14. a pair of deformed grooves 23 is provided on two sides of the pressing boss 19, respectively.

As illustrated in FIG. 1, a handbag made by the DIY splicing assembly is provided, including a main body 24 and a hand-strap 25. The main body 24 has a bottom surface 26 and four side surfaces 27 connected to the bottom surface 26. The basic pieces 1 adjacent to each other in two on the top of the main body 24 are connected by the two-leg fasteners 2 to form an upper edge of the main body 24. The basic pieces 1 to be spliced vertically in two are connected by the three-leg fasteners 3 to form a wrapped corner of the main body 24 with a right angle. The basic pieces 1 consecutive in the four directions are connected by the four-leg fasteners 4 to form a bottom surface 26 and four side surfaces 27 of the main body 24. The hand-strap 25 includes a handgrip portion 28 and a plurality of fastening portions 29. The fastening portions 29 are provided with a plurality of through holes 30 mating with the connecting holes 7 on the main body 24, and the fastening portions are connected to corresponding basic pieces 1 on the main body 24 through the four-leg fasteners 4.

As illustrated in FIG. 1, the main body 24 is provided with a rim 31 along the upper edge of the main body. The rim 31 is located on an inner side of the main body 24 and provided with a plurality of through holes corresponding to the connecting holes 7 on each of the basic pieces 1. Closure gaskets corresponding to the two-leg fasteners 2 are provided on the inner side of the rim 31. The two-leg fasteners 2 are plugged into holes on the gaskets via the connecting holes 7 and the through holes on the rim 31. A flower-shaped decorative piece 32 is provided on a front face of the main body 24. The flower-shaped decorative piece 32 may be directly disposed on the main body 24 through the four-leg fastener 4. If it is required to improve the stereoscopic impression of the handbag, the flower-shaped decorative piece 32 may be mounted by the decorative piece connecting component 6. Specifically, the flower-shaped decorative piece 32 is mounted, instead of the four-leg fastener 4 for connection, by the bottom leg fastener 13 in the decorative piece connecting component 6, the decorative piece 5 is then mounted so that the through hole 30 thereon corresponds to the inserting hole 17 on the bottom leg fastener 13, the inserting rod 18 of the pressing member 14 is inserted, the pressing boss 19 is tightly pressed against the decorative piece 5, and finally the inserting end 21 on the cap 15 is disposed inside the recess 20 on the pressing boss 19. The deformed grooves 23 on the two sides of the pressing boss 19 are configured to clamp the cap 15.

In order to improve the practicability, an inner bag 33 may be provided. The inner bag 33, having a row of holes 34 corresponding to the connecting holes 7 of the basic pieces 1 on the upper edge of the main body 24 formed on its upper edge, is provided inside the main body 24. Meanwhile, a fastening member may be further provided and disposed on the rim 31 of the main body 24, thereby improving the safety of the handbag and decorating the handbag.

In this embodiment, each of the basic pieces is formed by superposing an upper layer plastic sheet and a lower layer plastic sheet. A hollow structure is defined between the two layer plastic sheets and bonded on four edges. Gas or spongy material is filled in the hollow structure between the two layer plastic sheets to improve the hand feeling and stereoscopic impression of the handbag. Further, a fragrant material or a thermochromic material (which controls the change in color utilizing temperature difference, belonging to the field of dyeing assistants and dopes) may be also filled in the hollow structure to improve the personality and aesthetic sense. Certainly, the basic pieces may be solid and made of woods, plastic sheets, metals and the like.

Second Embodiment

As illustrated in FIGS. 8-12, a handbag made by the DIY splicing assembly is provided. The structure of the handbag in this embodiment is substantially similar to that in the first Embodiment, with the difference in that each of the basic pieces 1 is made of a paper board and including a central bottom piece 35 and a pair of folding pieces 36 located on two sides of the central bottom piece 35. Plug-in inserting holes 38 are provided where the folding pieces 36 on the two sides folded up overlap. A plurality of through holes 30 are provided on the central bottom piece 35 and the folding pieces 36, respectively. The corresponding through holes 30 in the central bottom piece 35 and the folding pieces 36 form the connecting holes 7.

Figure 12:
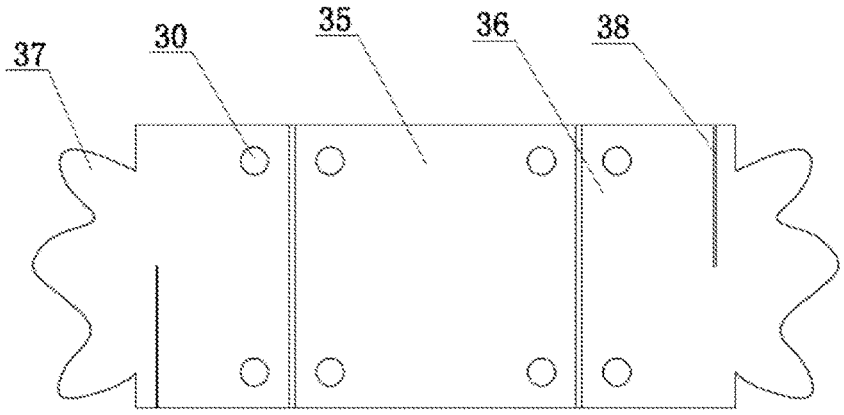
FIG. 12 is an expanded schematic structural view of FIG. 10.

An expanded view of the basic piece 1 is illustrated in FIG. 12. At ends of the folding pieces 36 on the left and right sides, there is a decorative leaf 37 formed of a plurality of line segments. The folding pieces 36 are folded and then plugged into each other through the centrosymmetrically arranged plug-in inserting holes 38, to form a basic piece 1. During assembling, the decorative leaves 37 on the folding pieces 36 form unique decorative pieces 5 of the handbag and make the handbag look stereoscopic.

The hand-strap 25 on the main body 24 may be also connected by the bottom leg fasteners 13 in the decorative piece connecting components 6, and the decorative pieces 5 may be then provided in virtue of the inserting holes on the bottom leg fasteners 13 in order to decorate the handbag.

Third Embodiment

Figure 13:
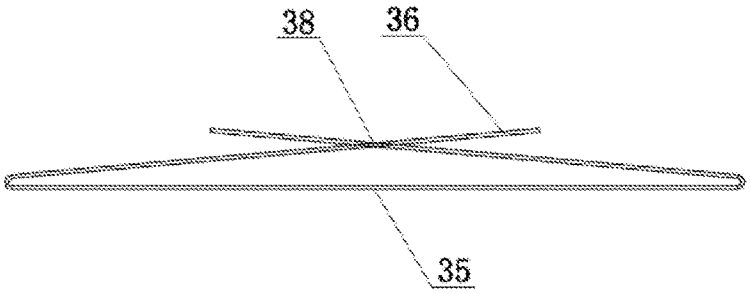
FIG. 13 is a schematic structural view of a basic piece according to Embodiment 3 of the present invention.
Figure 14:
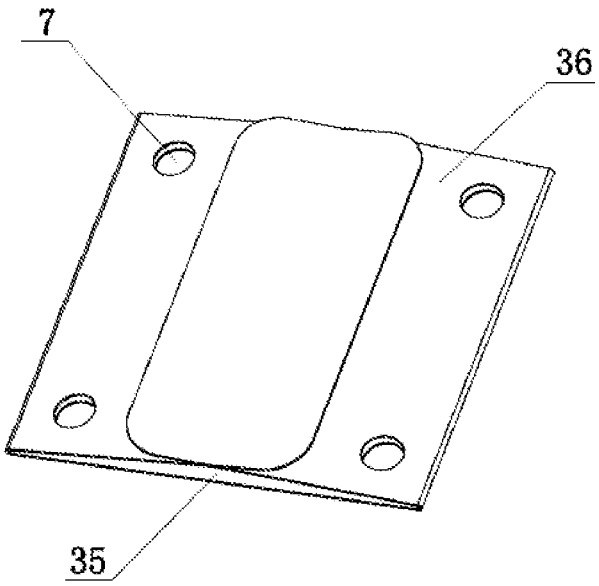
FIG. 14 is a stereoscopic schematic structural view of FIG. 13.
Figure 15:
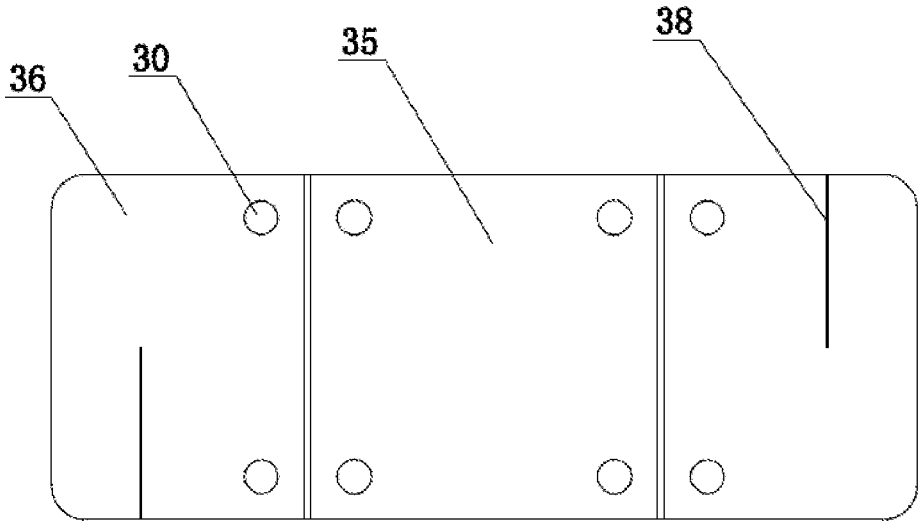
FIG. 15 is an expanded schematic structural view of FIG. 13.

As illustrated in FIGS. 13-15, a handbag made by the DIY splicing assembly is provided. The structure of the handbag in this embodiment is substantially similar to that in the second Embodiment, with the difference in that each of the basic pieces 1 is made of a plastic sheet including a central bottom piece 35 and a pair of folding pieces 36 located on two sides of the central bottom piece 35. Plug-in inserting holes 38 are provided where the folding pieces 36 on the two sides folded up overlap. A plurality of through holes 30 are provided on the central bottom piece 35 and the folding pieces 36, respectively. The corresponding through holes 30 in the central bottom piece 35 and the folding pieces 36 form the connecting holes 7.

An expanded view of the basic piece 1 is illustrated in FIG. 15. In the middle parts of the folding pieces 36 on the left and right sides, there are centrosymmetrically arranged plug-in inserting holes 38 through which the folding pieces 36 are folded and then plugged into each other to form one basic piece 1.

The present invention has been described in sufficient details with a certain degree of particularity. It is understood to those skilled in the art that the present disclosure of embodiments has been made by way of examples only and that numerous changes in the arrangement and combination of parts may be resorted without departing from the spirit and scope of the invention as claimed. Accordingly, the scope of the present invention is defined by the appended claims rather than the foregoing description of embodiments.

What is claimed is:

1. A DIY splicing assembly, comprising:

a plurality of basic pieces, each having a rectangular shape and having defined therein four connecting apertures in four corners thereof respectively;

a plurality of two-leg fasteners, each having two legs fitting the connecting apertures and a connecting rod connecting the two legs, and configured to connect two of the basic pieces adjacent to each other;

a plurality of four-leg fasteners, each having four legs fastened to the connecting apertures and a connecting piece connecting the four legs, and configured to connect four of the basic pieces adjacent to each other;

a plurality of decorative pieces, each having defined therein a plurality of through apertures matching with one of the connecting apertures;

a plurality of decorative piece connecting components, each comprising a bottom leg fastener and at least one pressing member, the bottom leg fastener having four legs fastened to the connecting apertures and a platform connecting the four legs and defining an inserting aperture, the pressing member having an inserting rod on the bottom thereof mating with the inserting aperture, and a pressing boss formed at an upper end of the inserting rod, a recess mating with a bottom of the inserting rod being provided in a middle of the pressing boss; and wherein some of said four-leg fastener, said two-leg fastener and said decorative piece connecting components attach to same or different ones of the basic pieces.

2. The DIY splicing assembly according to claim 1, further comprising a plurality of three-leg fasteners, each having three legs fastened to the connecting apertures and a crossing rod connecting the three legs and configured to connect the basic pieces to be spliced vertically in two to form a wrapped corner with a right angle.

3. The DIY splicing assembly according to claim 1, wherein each decorative piece connecting component further comprises a cap including an inserting end having the bottom that couples in a plug-in fit configuration to the recess and a crown having a top covering a top face of the pressing member, and wherein two deformed grooves are defined on two sides of the pressing boss, respectively.

4. The DIY splicing assembly according to claim 1, wherein each basic piece comprises an upper layer plastic sheet and a lower layer plastic sheet, and a hollow structure is defined between the upper layer plastic sheet and the lower layer plastic sheet, and four edges of the basic piece are bonded.

5. The DIY splicing assembly according to claim 4, wherein the hollow structure defined between the upper and lower layer plastic sheets is filled with one or more of a spongy material, a fragrant material and a thermochromic material.

6. A splicing handbag, comprising:

a main body defining a bottom surface and four side surfaces connected to the bottom surface, the main body comprising:

a plurality of basic pieces each having a rectangular shape and having defined therein four connecting apertures in four corners thereof respectively;

a plurality of two-leg fasteners each having two legs fitting the connecting apertures and a connecting rod connecting the two legs, and configured to connect two basic pieces adjacent to each other to form an upper edge of the main body;

a plurality of three-leg fasteners each having three legs fastened to the connecting apertures and a crossing rod connecting the three legs and configured to connect the basic pieces to be spliced vertically in two to form a wrapped corner with a right angle of the main body;

a plurality of four-leg fasteners each having four legs fastened to the connecting apertures and a connecting piece connecting the four legs, and configured to connect four basic pieces adjacent to each other to form a bottom surface and four side surfaces of the main body;

a hand-strap comprising a handgrip portion and fastening portions having defined therein a plurality of through apertures mating with the connecting apertures on the main body; and wherein some of said four-leg fastener, said three-leg fastener, said two-leg fastener and said decorative piece connecting components attach to same or different ones of the basic pieces.

7. The handbag according to claim 6, wherein the main body further comprises:

a plurality of decorative pieces, each having defined therein a plurality of through apertures matching with the connecting apertures; and a plurality of decorative piece connecting components, each comprising a bottom leg fastener and at least one pressing member, the bottom leg fastener having four legs fastened to the connecting apertures and a platform connecting the four legs and defining an inserting aperture, the pressing member having an inserting rod on the bottom thereof mating with the inserting aperture, and a pressing boss formed at an upper end of the inserting rod, a recess mating with a bottom of the inserting rod and being defined in a middle of the pressing boss.

8. The handbag according to claim 6, wherein the main body is provided with a rim along the upper edge of the main body and located on an inner side of the main body, and the rim having defined therein a plurality of through apertures corresponding to the connecting apertures on the basic pieces; closure gaskets corresponding to the two-leg fasteners are provided on the inner side of the rim; and the two-leg fasteners are plugged into apertures defined on the gaskets via the connecting apertures and the through apertures defined on the rim.

9. The handbag according to claim 6, wherein the main body further comprises an inner bag having defined therein a row of apertures formed on its upper edge corresponding to the connecting apertures of the basic pieces on the upper edge of the main body.

10. The handbag according to claim 6, wherein each basic piece comprises an upper layer plastic sheet and a lower layer plastic sheet, a hollow structure is defined between the upper layer plastic sheet and the lower layer plastic sheet, four edges of the basic piece are bonded, and the hollow structure defined between the upper and lower layer plastic sheets is filled with one or more of a spongy material, a fragrant material and a thermochromic material.

* * * * *